US009508524B2

(12) United States Patent
Yanagisawa et al.

(10) Patent No.: US 9,508,524 B2
(45) Date of Patent: Nov. 29, 2016

(54) RADIATION GENERATING APPARATUS AND RADIATION IMAGING APPARATUS

(75) Inventors: Yoshihiro Yanagisawa, Fujisawa (JP); Kazuyuki Ueda, Tokyo (JP); Ichiro Nomura, Atsugi (JP); Miki Tamura, Kawasaki (JP); Shuji Aoki, Yokohama (JP); Kazuhiro Sando, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 183 days.

(21) Appl. No.: 14/233,172

(22) PCT Filed: Jul. 11, 2012

(86) PCT No.: PCT/JP2012/068255
§ 371 (c)(1),
(2), (4) Date: Jan. 16, 2014

(87) PCT Pub. No.: WO2013/021794
PCT Pub. Date: Feb. 14, 2013

(65) Prior Publication Data

US 2014/0140486 A1 May 22, 2014

(30) Foreign Application Priority Data

Aug. 5, 2011 (JP) ..... 2011-171610

(51) Int. Cl.
*H01J 35/12* (2006.01)
*H05G 1/02* (2006.01)
(Continued)

(52) U.S. Cl.
CPC ..... *H01J 35/12* (2013.01); *H01J 35/16* (2013.01); *H05G 1/025* (2013.01); *H05G 1/04* (2013.01); *H01J 2235/122* (2013.01); *H01J 2235/166* (2013.01); *H01J 2235/186* (2013.01)

(58) Field of Classification Search
USPC ..... 378/141
See application file for complete search history.

(56) References Cited

U.S. PATENT DOCUMENTS 4,250,425 A 2/1981 Gabbay et al. ..... 313/60
4,292,563 A 9/1981 Gabbay et al. ..... 313/56
(Continued)

FOREIGN PATENT DOCUMENTS

CN 2134771 5/1993
CN 1391870 1/2003
(Continued)

OTHER PUBLICATIONS

DeWitt, et al. "Fundamentals of Heat and Mass Transfer (6 ed.)", New York (2007): John Wiley & Sons. pp. 2-168.*
(Continued)

*Primary Examiner* — Phillip A Johnston
(74) *Attorney, Agent, or Firm* — Fitzpatrick, Cella, Harper & Scinto

(57) ABSTRACT

A radiation generating apparatus of the present invention includes an envelope 1 including a first window 2 allowing radiation to pass; a radiation tube 10 that is accommodated in the envelope 1, and includes a second window 15 allowing radiation to pass, at a position opposite to the first window 2; a radiation passing hole 21 that is thermally connected to the second window 15 and communicates with the second window 15; and a radiation shielding member 16 protruding from the second window 15 toward the first window 2. In this apparatus, a thermally conductive member 17 having a higher thermal conductivity than the radiation shielding member 16 is connected to an outer periphery of the protruding portion of the radiation shielding member 16. The simple configuration can shield unnecessary radiation, and cool the target, while facilitating reduction in weight.

17 Claims, 6 Drawing Sheets

(51) Int. Cl.
*H05G 1/04* (2006.01)
*H01J 35/16* (2006.01)

(56) References Cited

U.S. PATENT DOCUMENTS

| | | | | |
|---|---|---|---|---|
| 6,661,876 | B2 | 12/2003 | Turner et al. | 378/138 |
| 6,707,882 | B2 * | 3/2004 | Bittner | H01J 35/101 378/130 |
| 7,623,629 | B2 * | 11/2009 | Ito | H01J 9/26 378/121 |
| 8,472,585 | B2 | 6/2013 | Ogura et al. | 378/111 |
| 2002/0191734 | A1 | 12/2002 | Kojima et al. | 378/4 |
| 2003/0021377 | A1 | 1/2003 | Turner et al. | 378/138 |
| 2005/0053188 | A1 | 3/2005 | Gohno | 378/15 |
| 2006/0008057 | A1 | 1/2006 | Daniel | 378/203 |
| 2008/0043919 | A1 | 2/2008 | Chapin et al. | 378/119 |
| 2009/0010393 | A1 | 1/2009 | Klinkowstein et al. | 378/121 |
| 2009/0232270 | A1 | 9/2009 | Okunuki et al. | 378/5 |
| 2010/0046715 | A1 * | 2/2010 | Freudenberger | G21F 1/00 378/140 |
| 2012/0140895 | A1 | 6/2012 | Okunuki et al. | 378/122 |
| 2012/0307974 | A1 | 12/2012 | Yamazaki et al. | 378/62 |
| 2012/0307978 | A1 | 12/2012 | Yamazaki et al. | 378/121 |
| 2013/0016810 | A1 | 1/2013 | Tamura et al. | 378/62 |
| 2013/0016811 | A1 | 1/2013 | Ueda et al. | 378/62 |
| 2013/0016812 | A1 | 1/2013 | Yanagisawa et al. | 367/62 |
| 2013/0034207 | A1 | 2/2013 | Aoki et al. | 378/62 |
| 2013/0148781 | A1 | 6/2013 | Yamazaki et al. | 378/62 |
| 2013/0230143 | A1 | 9/2013 | Ueda et al. | 378/62 |
| 2013/0235975 | A1 | 9/2013 | Tamura et al. | 378/62 |
| 2014/0140480 | A1 | 5/2014 | Ogura et al. | 378/140 |
| 2014/0140486 | A1 | 5/2014 | Yanagisawa et al. | 378/141 |
| 2014/0153695 | A1 | 6/2014 | Yanagisawa et al. | 378/142 |

FOREIGN PATENT DOCUMENTS

| | | | | |
|---|---|---|---|---|
| CN | 1593344 | | 3/2005 | |
| CN | 1794899 | | 6/2006 | |
| CN | 101128081 | | 2/2008 | |
| CN | 101521136 | | 9/2009 | |
| FR | 2415876 | A * | 1/1978 | H01J 35/00 |
| FR | 2 415 876 | A1 | 8/1979 | |
| GB | 762375 | A | 11/1956 | |
| JP | 2004-235113 | A | 8/2004 | |
| JP | A2005-523558 | | 8/2005 | |
| JP | 2007-265981 | A | 10/2007 | |
| JP | 2009-043651 | | 2/2009 | |
| JP | 2013-055041 | | 3/2013 | |

OTHER PUBLICATIONS

Office Action issued on Jun. 15, 2015, in counterpart Chinese patent application 201280037295.9, with translation.

Japanese Office Action issued on Sep. 1, 2015 in Japanese patent application 2012-160118.

Japanese Office Action issued on Oct. 6, 2015 in Japanese patent application 2012-160119.

EPO Office Action issued on Mar. 1, 2016 in counterpart European patent application 12741117.1; in English.

* cited by examiner

RADIATION GENERATING APPARATUS AND RADIATION IMAGING APPARATUS

TECHNICAL FIELD

The present invention relates to a radiation generating apparatus and a radiation imaging apparatus using the same that are applicable to medical apparatuses and non-destructive X-ray imaging in industrial apparatus fields.

BACKGROUND ART

In general, a radiation tube accelerates electrons emitted from an electron emitting source by a high voltage, and irradiates a target to thereby generate radiation, such as X-rays. The radiation generated at this time is emitted in all directions. PTL 1 discloses a transmission X-ray generating apparatus including an X-ray shielding member disposed on an electron incident side and an X-ray emitting side with respect to a target for shielding unnecessary X-rays.

It is required to apply a high voltage between the electron emitting source and the target to irradiate the target with a high energy electron beam, to generate radiation suitable for radiation imaging. However, in general, the radiation generation efficiency is quite low, and about 99% of the power consumed becomes heat.

The generated heat elevates the temperature of the target, which necessitates some means for preventing the target from being thermally damaged. PTL 2 discloses an X-ray generating tube that includes a cooling mechanism around an X-ray transmission window to thereby improve the heat radiation efficiency for the target portion.

CITATION LIST

Patent Literature

PTL 1: Japanese Patent Application Laid-Open No. 2007-265981

PTL 2: Japanese Patent Application Laid-Open No. 2004-235113

SUMMARY OF INVENTION

Technical Problem

In imaging with short time pulses and a large tube current in the medical field and imaging with a focused electron beam in the industrial field, the temperature of the target may be instantaneously increased. In such a case, heat radiation only through a conventional radiation shielding member is insufficient.

A heavy metal is typically adopted for the radiation shielding member. Accordingly, if the radiation shielding member is thickened to improve the heat radiation property, the overall weight of the radiation generating apparatus is increased. If the cooling mechanism is separately provided in addition to the radiation shielding member, it becomes difficult to reduce the size of the radiation generating apparatus as a whole.

It is thus an object of the present invention to provide a radiation generating apparatus that can shield unnecessary radiation and cool a target with a simple structure while facilitating reduction in weight, and a radiation generating apparatus using the same.

Solution to Problem

In order to achieve the object, according to an aspect of the present invention, a radiation generating apparatus comprises: an envelope having a first window through which a radiation passes; and a radiation tube held within the envelope and having a second window through which the radiation passes, wherein the first and second windows are arranged in opposition to each other, and wherein the radiation tube has a radiation shielding member, with a radiation passing hole in communication with the second window, having a protruding portion protruding from the second window toward a side of the first window, and a thermally conductive member having a thermal conductivity higher than that of the radiation shielding member is placed at an outer side of the protruding portion of the radiation shielding member.

Advantageous Effect of Invention

The present invention can secure performance of shielding unnecessary radiation, and effectively radiate the heat of a target. Furthermore, the thermally conductive member having a lower density than the radiation shielding member is adopted. Accordingly, the overall weight of the radiation generating apparatus can be reduced. This configuration allows radiation imaging with a large tube current and a microfocus, and enables a high resolution taken image to be acquired. Moreover, reduction in size and weight facilitates application to home medical testing and emergency on-site medical testing.

Further features of the present invention will become apparent from the following description of exemplary embodiments with reference to the attached drawings.

DESCRIPTION OF EMBODIMENTS

Embodiments of the present invention will hereinafter be described with reference to drawings.

Figure 1:
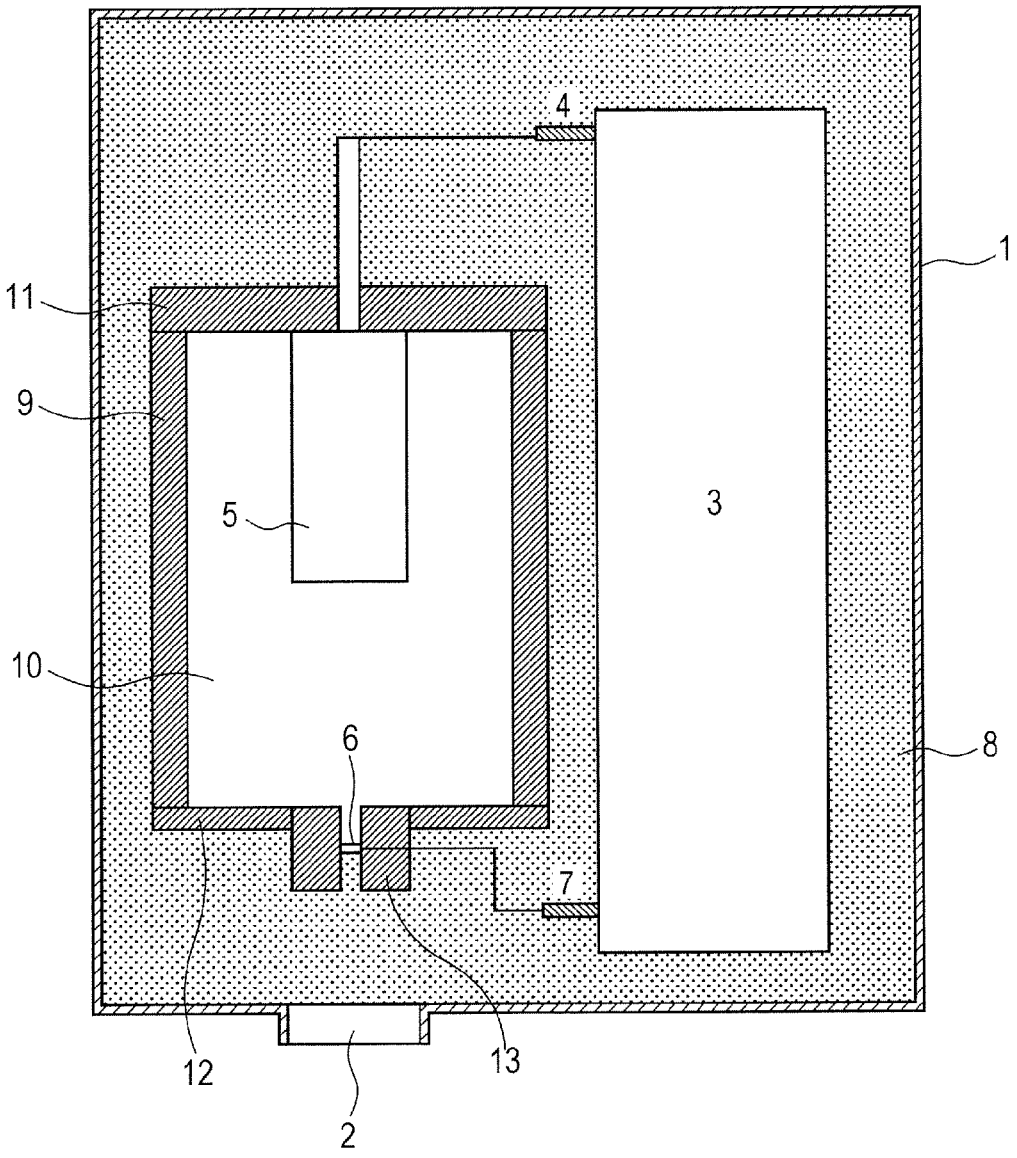
FIG. 1 is a schematic sectional view illustrating a radiation generating apparatus of the present invention.

FIG. 1 is a schematic sectional view illustrating one embodiment of a radiation generating apparatus of the present invention. An envelope 1 accommodates a transmission radiation tube 10 and a voltage control unit 3 (voltage control unit). The rest of the space in the envelope 1 (between the inner walls of the envelope 1 and the radiation tube 10) is filled with an insulating fluid 8.

The voltage control unit 3 includes a circuit board and an insulated transformer, and outputs a signal for controlling occurrence of radiation to an electron emitting source 5 of the radiation tube 10 via a terminal 4. Furthermore, this unit defines the voltage of an anode portion 12 via the terminal 7.

The envelope 1 may have a strength sufficient for a container, and is made of one of a metal and a plastic material.

The insulating fluid 8 is one of a liquid and a gas that is electrically insulating and disposed as a cooling medium. In the case of a liquid, an electrically insulating oil is suitable. Any of a mineral oil and a silicone oil is suitable as an electrically insulating oil. Another usable insulating fluid 8 is a fluorinated electrically insulating liquid. In the case of a gas, atmospheric gas can be used, thereby reducing the weight of the apparatus in comparison with a case where an insulating liquid is used.

The envelope 1 is provided with a first window 2 through which radiation passes and which is for capturing the radiation at the outside. The radiation emitted from the radiation tube 10 is further emitted through the first window 2 to the outside. Any of glass, aluminum and beryllium is used for the first window 2.

The radiation tube 10 includes: a cylindrical evacuated container 9 as an outer frame; and an electron emitting source 5, a target assembly 6 and a window member 8 that are disposed therein.

The evacuated container 9 is for maintaining the inside of the radiation tube 10 to be evacuated. Any of insulating materials, such as glasses and ceramics, is adopted as the body. A cathode portion 11 and the anode portion 12 are made of a conductive alloy (kovar). The degree of vacuum in the evacuated container 9 may be about $10^{-4}$ to $10^{-8}$ Pa. A getter, not illustrated, may be arranged in the evacuated container 9 to maintain the degree of vacuum. The evacuated container 9 further includes a cylindrical aperture portion at the anode portion 12. A cylindrical window member 13 is coupled to the wall surface of the aperture portion. A cylindrical radiation passing hole (hereinafter simply referred to as the passing hole) 21, which allows a part of radiation (X-rays in this embodiment) generated from the target assembly 6 to pass, is formed in the window member 13. The cylindrical target assembly 6 is coupled to the inner wall of the passing hole 21, thereby allowing the evacuated container 9 to be sealed.

The electron emitting source 5 is disposed opposite to the target assembly 6 in the evacuated container 9. Any of hot cathodes, such as a tungsten filament and an impregnated cathode, and cold cathodes, such as carbon nanotubes, can be adopted for the electron emitting source 5. An extraction electrode is arranged at the electron emitting source 5. Electrons emitted by an electric field formed by the extraction electrode are converged by a lens electrode, and are incident on the target 6 to emit radiation. At this time, an acceleration voltage of about 40 to 120 kV is applied between the cathode portion 11 electrically connected to the electron emitting source 5 and the anode portion 12 electrically connected to the target 14; the voltage is different according to usage of the radiation.

FIGS. 2A to 2F are a schematic sectional view in which a peripheral portion of the window member 13 in FIG. 1 is enlarged.

The target assembly 6 includes the target 14, and a substrate 15 as a second window. The target 14 is disposed on a surface of the second window 15 on a side of the electron emitting source. A material having a high melting point and high radiation generation efficiency is suitable for the material configuring the target 14. For instance, any of tungsten, tantalum and molybdenum can be adopted. It is appropriate that the target 14 have a thickness of about from several micrometers to several tens of micrometers, to reduce absorption caused when the generated radiation passes through the target 14.

The second window 15 supports the target 14, allows at least a part of radiation generated by the target 14 to pass therethrough, and is disposed at a position in the radiation passing hole 21 in the window member 13, the position being opposite to the first window 2. A material that has a strength capable of supporting the target 14, a small amount of absorption of radiation generated in the target 14, and a high thermal conductivity for allowing heat generated at the target 14 to be quickly radiated is suitable for the material configuring the second window 15. For instance, any of diamond, silicon nitride and aluminum nitride can be adopted. To satisfy the requirements for the second window 15, the second window 15 suitably has a thickness of about 0.1 to several millimeters.

Figure 2A:
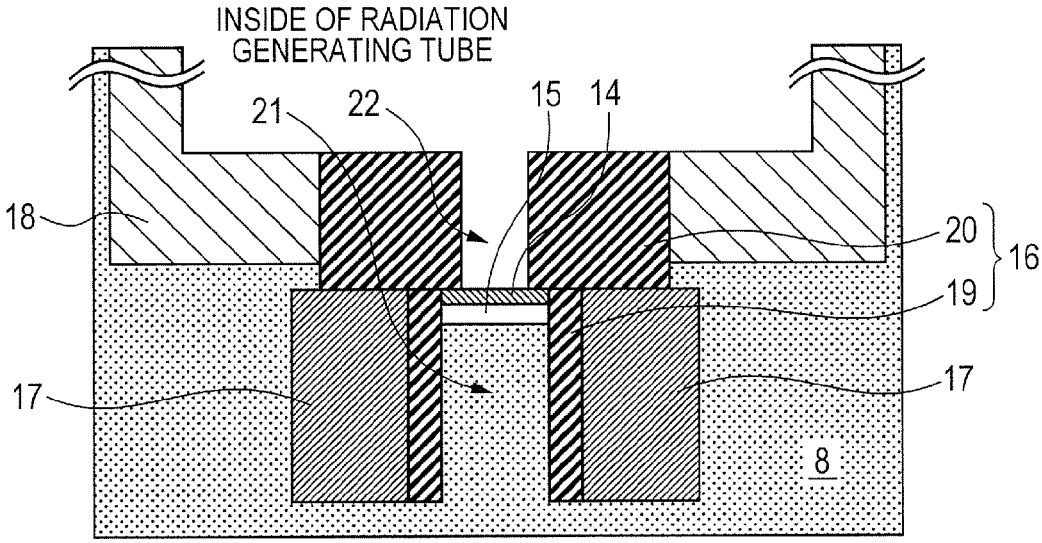
FIGS. 2A, 2B, 2C, 2D, 2E and 2F are a schematic sectional view illustrating a peripheral portion of a radiation shielding member according to one embodiment of the present invention.

As illustrated in FIG. 2A, the window member 13 includes a radiation shielding member (hereinafter simply referred to as the shielding member) 16 and a thermal conducting member 17. The shielding member 16 has a passing hole 21 communicating with the second window 15, and shields unnecessary radiation among radiation emitted from the target 14. The shielding member 16 includes two shielding members (a first shielding member 20 and a second shielding member 19). The first shielding member 20 and the second shielding member 19 may be made of the same material; the shielding members may be formed in an integrated manner, or disposed separately. The shielding members may be made of respective different materials; the shielding members may be formed in an integrated manner, or disposed separately. The second window 15 is fixed to the shielding member 16, thereby allowing vacuum airtightness of the evacuated container 9 to be maintained. A silver brazing can be used for fixation according thereto.

The first shielding member 20 is disposed to protrude from the second window 15 toward the electron emitting source 5 (opposite to the second shielding member 19, which is described below) and forms an electron beam passing hole 22 communicating with the second window 15. Electrons emitted from the electron emitting source 5 pass through the electron beam passing hole 22 and collide with the target 14. Radiation scattered toward the electron emitting source from the target 14 among radiation having occurred at the target 14 is shielded by the first radiation shielding member 20.

The second shielding member 19 is disposed to protrude from the second window 15 toward the first window 2, and includes a passing hole 21 communicating with the second window 15. Radiation having passed through the second window 15 further passes through the passing hole 21. Unnecessary radiation is shielded by the second shielding member 19.

With a view toward taking as much radiation to the outside of the envelope 1 as possible, it is suitable that the opening area of the passing hole 21 gradually increase from the second window 15 toward the first window 2. This configuration is adopted because radiation passing through the second window 15 spreads radially.

It is appropriate that the center of the electron beam passing hole 22 of the first shielding member 20, the center of the passing hole 21 of the second shielding member 19 and the center of the target 14 be on the same line. This arrangement is adopted to allow more radiation generated by irradiating the transmission target 14 with electrons to be taken more securely.

A material having a high absorptance of radiation and a high thermal conductivity is suitably adopted as the material configuring the shielding member 16. For instance, any of metal materials, such as tungsten and tantalum and alloys thereof can be adopted. It is appropriate that the thicknesses of the first shielding member 20 and the second shielding member 19 be about 0.5 to 5 mm to sufficiently shield unnecessary radiation, even though the thicknesses depend on the set acceleration voltage for the electrons.

Figure 2B:
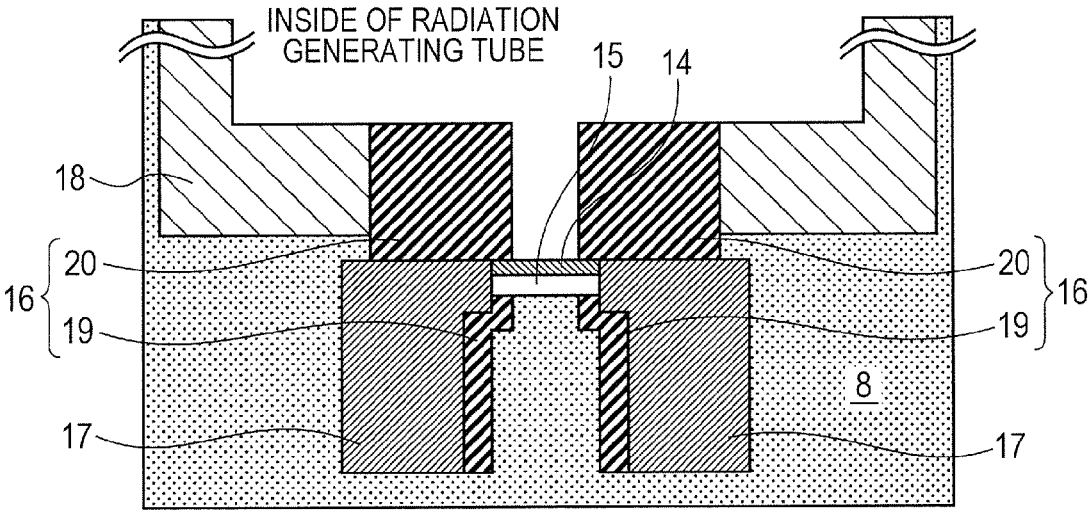

As illustrated in FIGS. 2A and 2B, the thermally conductive member 17 is arranged around the second shielding member 19 to encircle this second shielding member 19. The thermally conductive member 17 is coupled to the second shielding member 19 by any of brazing, molding, soldering, welding, laser welding, screwing, shrink fitting, taper fitting, adhesive, and mechanical screwing. The thermally conductive member 17 and the second shielding member 19 have concentric cylindrical shapes. The thermally conductive member 17 is larger in thickness in the radial direction than the second shielding member 19.

It is appropriate that the material configuring the thermally conductive member 17 have a higher thermal conductivity and higher heat resistance than the shielding member 16. Any of metal materials, carbon series materials and ceramics can be adopted. Any of silver, copper, aluminum, cobalt, nickel, iron, and alloys and oxides thereof may be adopted among metal materials. Any of diamond and graphite may be adopted among carbon series materials. Any of aluminum nitrides, silicon carbides, alumina, and silicon nitrides may be adopted among ceramics. Furthermore, it is appropriate that a material having a lower density than the radiation shielding member 16 be adopted as the material configuring the thermally conductive member 17.

In the case of adopting a material having a smaller density than the shielding member 16 as the thermally conductive member 17, the weight can be reduced in comparison with the case of a configuration where the window member 13 only includes the shielding member 16.

Heat generated at the target 14 is conducted directly or via the second window 15 to the thermal conducting member 17, or conducted to the thermally conductive member 17 via the shielding member 16. The heat is further conducted to the insulating fluid in contact with the thermally conductive member 17 and quickly radiated, thereby suppressing increase in temperature of the target 14. The thermal conductivity of the thermally conductive member 17 is higher than the thermal conductivity of the shielding member 16. Accordingly, in the case where the window member 13 only includes the shielding member 16, the speed of heat radiation is increased.

Figure 3:
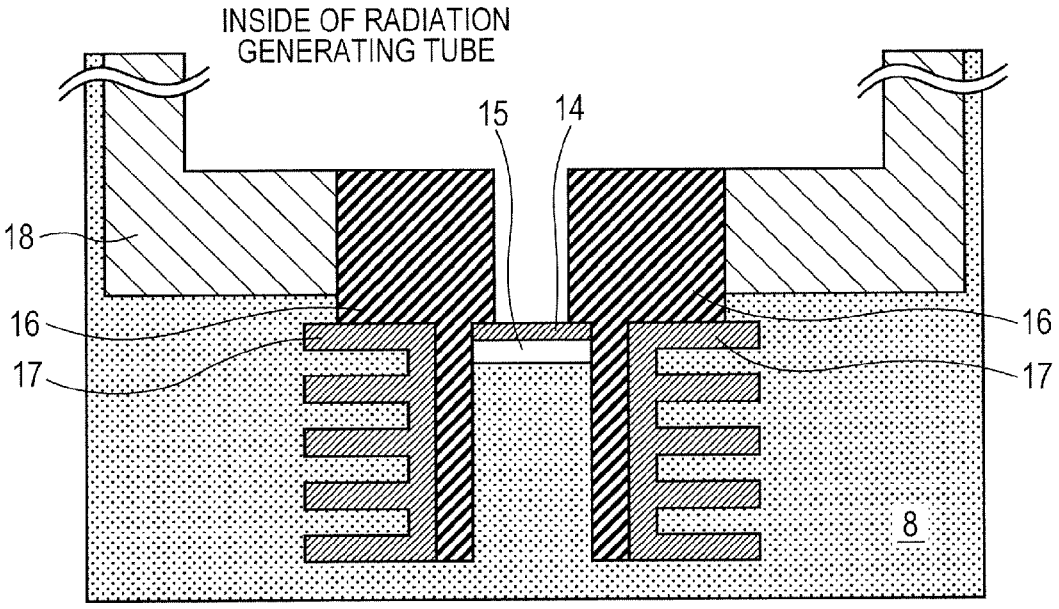
FIG. 3 is a schematic sectional view illustrating a peripheral portion of a radiation shielding member according to another embodiment of the present invention.

As further illustrated in FIG. 3, in the case where the thermally conductive member 17 has a fin structure, the area of the thermally conductive member 17 that is in contact with the insulating fluid is becomes large. Accordingly, the heat is radiated more effectively.

The thermally conductive member 17 may be partially disposed at the outer or inner periphery of the second shielding member 19, instead of being formed to encircle the entire outer or inner periphery.

To improve the heat radiation property, the shielding member 16 and the thermally conductive member 17 are appropriately configured such that the target assembly 6 is disposed to protrude toward the first window 2 beyond the position of the end face of the evacuated container 9.

Either of anode grounding and midpoint grounding can be adopted as a scheme of applying an acceleration voltage. Anode grounding is a scheme of setting the potential of the target 14 as the anode to ground (0 [V]) while setting the potential of the electron emitting source 5 relative to ground to −Va [V], where the voltage applied between the target 14 and the electron emitting source 5 is Va [V]. Meanwhile, the midpoint grounding is a scheme of setting the potential of the target 14 relative to ground to +(Va−α) [V] while setting the potential of electron emitting source 5 relative to ground to −α [V] (note that Va>α>0). The value of α is any value in an extent Va>α>0. Typically, the value is close to Va/2. In the case of adopting the midpoint grounding, the absolute value of the potential relative to ground can be reduced, and the creepage distance can be shortened. Here, the creepage distance is the distance between the voltage control unit 3 and the envelope 1, and the distance between the radiation tube 10 and the envelope 1. If the creepage distance can be shortened, the size of the envelope 1 can be reduced. Accordingly, the weight of the insulating fluid 8 can be reduced according thereto, thereby allowing the size and weight of the radiation generating apparatus to be further reduced.

Example 1

Tungsten is selected for the shielding member 16, into which the first shielding member 19 and the second shielding member 20 are formed in the integrated manner as illustrated in FIG. 2A. Copper is selected for the thermally conductive member 17. The thermally conductive member 17 is fixed by brazing to the outer periphery of a portion protruding from the second window 15 of the shielding member 16 toward the first window 2. An insulating oil made of a mineral oil is adopted as the insulating fluid 8. Midpoint grounding is used for voltage control. A tungsten filament is adopted as the electron emitting source 5, which is heated by a heating unit, not illustrated, to emit electrons. The emitted electrons are accelerated to a high energy, according to electron beam trajectory control by a potential distribution caused by a voltage applied to the extraction electrode and the lens electrode, and the voltage Va applied between the electron emitting source 5 and the target 14, thereby colliding with target and causing radiation. A thin film tungsten is adopted as the target 14. The voltage of the target 14 is set to +50 [kV] and the voltage of the electron emitting source 5 is set to −50 [kV] such that the extraction electrode is 50 [V], the lens electrode is 1000 [V] and the midpoint grounding is Va of 100 [kV].

Example 2

As illustrated in FIG. 2B, in this example, the first shielding member 19 and the second shielding member 20 are disposed separately. The thermally conductive member 17 is disposed at an outer periphery of the first shielding member 19 such that a part of the thermally conductive member 17 is in directly contact with the second window 15. This example is similar in configuration to Example 1 except that a part of heat generated at the second window 15 is directly conducted to the thermally conductive member 17 without passing through the first shielding member 19 and thereby the heat radiation speed is further increased.

Example 3

Figure 2C:
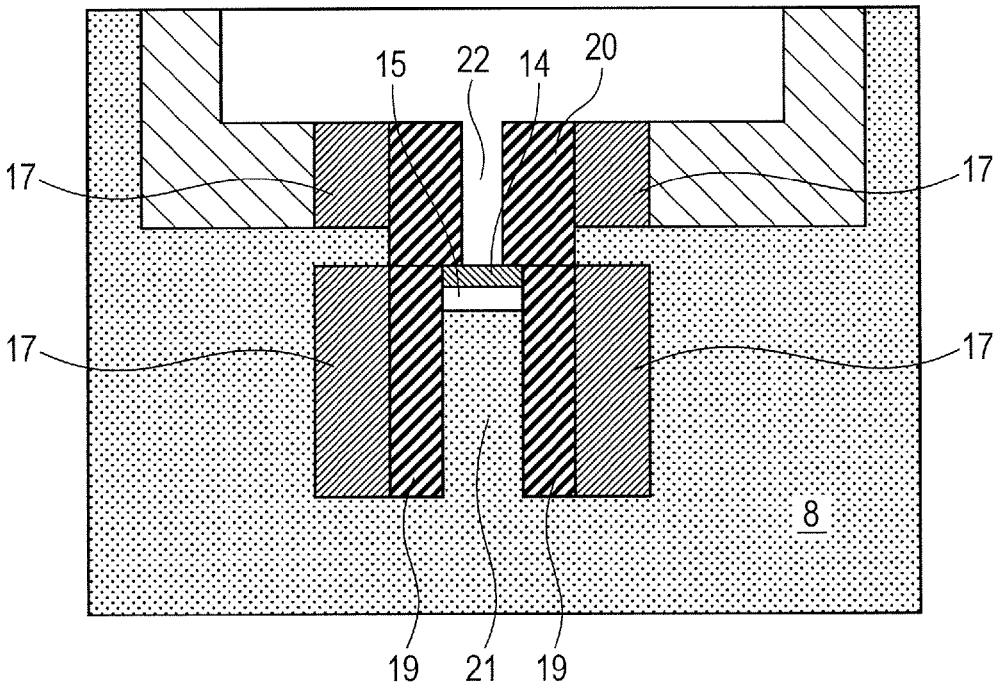

As illustrated in FIG. 2C, in this example, the thermally conductive member 17 is connected to a part of an outer periphery of a protrusion of the shielding member 16 and also provided between the wall surface of the aperture portion of the evacuated container 9 and the shielding member 16. This example is similar in configuration to Example 1 except for this point.

Example 4

Figure 2D:
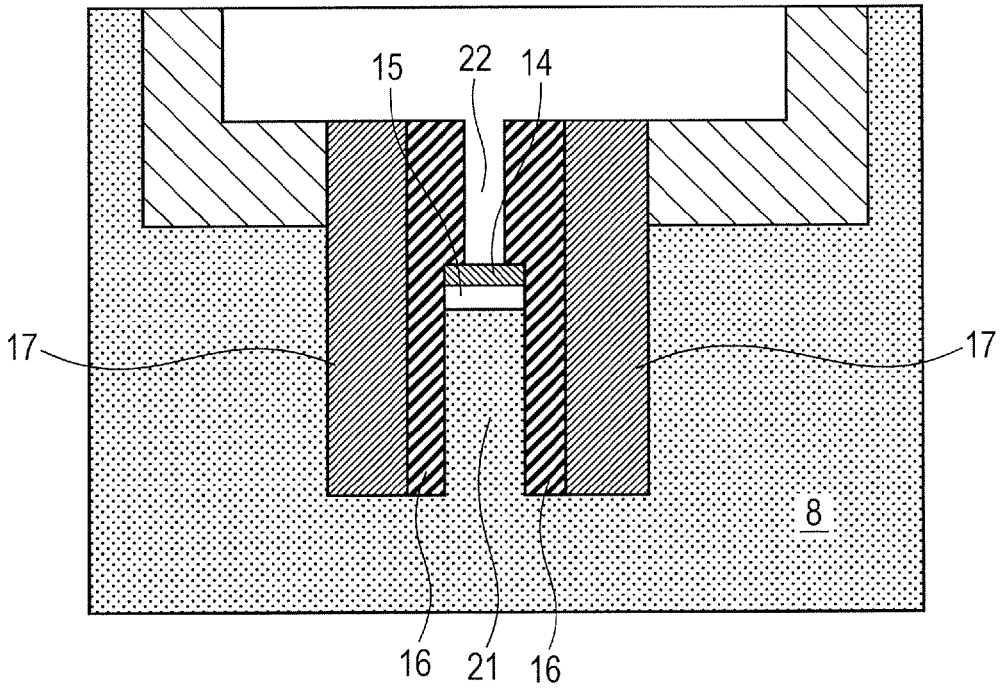

As illustrated in FIG. 2D, in this example, the thermally conductive member 17 is provided at the entire outer periphery of the shielding member 16. This example is similar in configuration to Example 1 except for this point.

Example 5

Figure 2E:
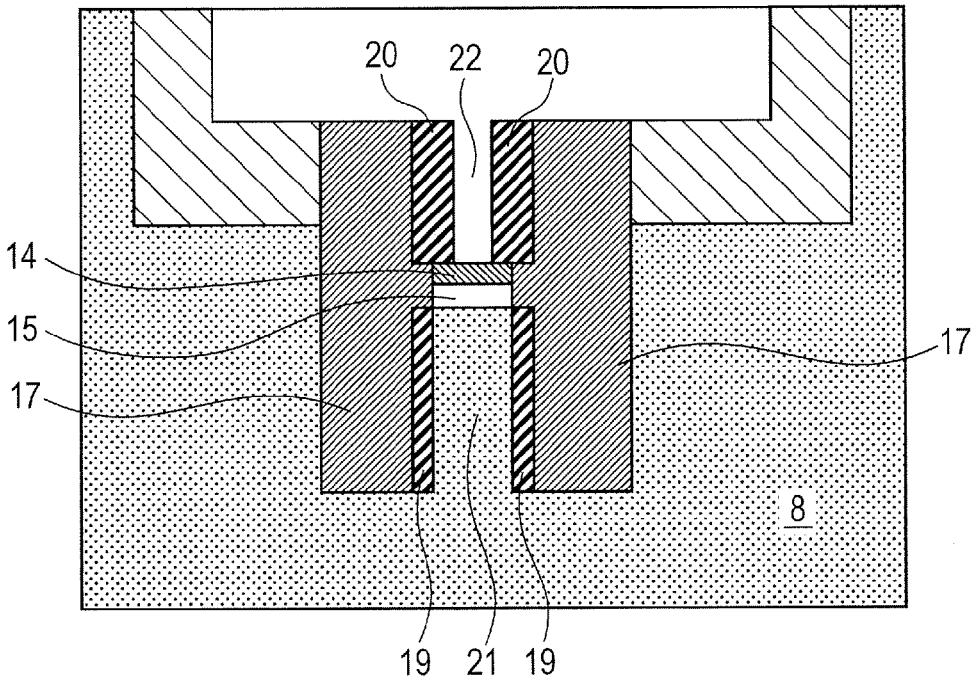

As illustrated in FIG. 2E, in this example, the thermally conductive member 17 is disposed at the entire outer periphery of the first shielding member 19 so as to be in direct contact with the second window 15. This example is similar in configuration to Example 2 except for this point.

Example 6

Figure 2F:
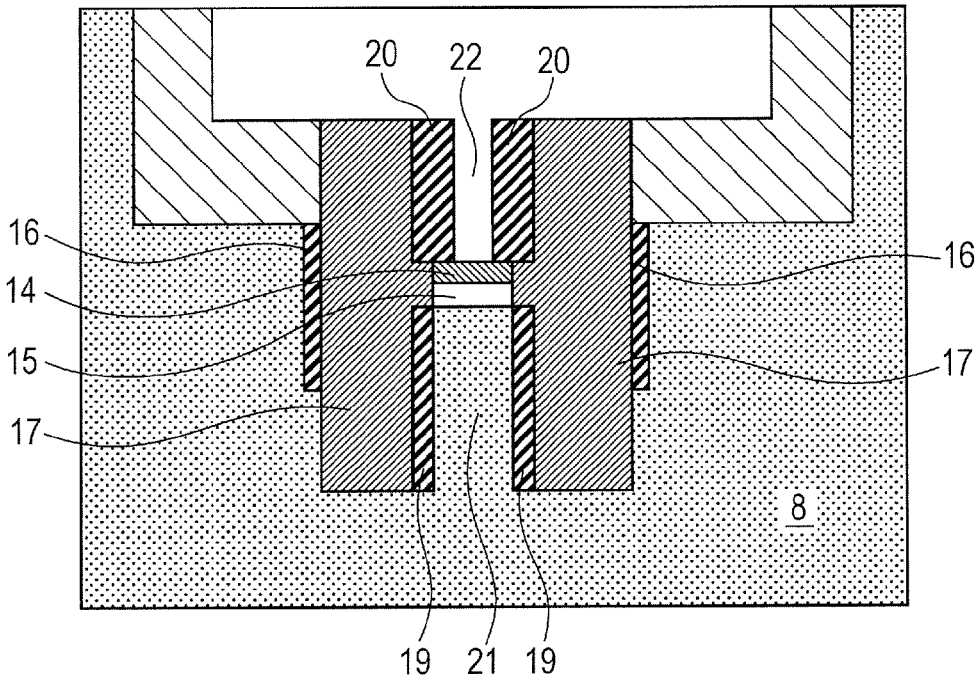

As illustrated in FIG. 2F, in this example, the shielding member 16 is also disposed at a part that is an outer periphery of the thermally conductive member 17 and includes a position opposite to a position where the thermally conductive member 17 is in contact with the target 14. This example is similar in configuration to Example 5 except for this point. Radiation passing through the thermally conductive member 17 and scattered to the outside among radiation occurring at target 14 can be blocked, accordingly improving the shielding of unnecessary radiation.

Example 7

This example is similar to Example 1 except that molybdenum is selected for the shielding member 16, aluminum is selected for the thermally conductive member 17, and a thin film molybdenum is adopted as the target 14. Note that this example is different from Example 1 in that anode grounding is used for voltage control. The voltage of the target 14 is set to +50 [kV] and the voltage of the electron emitting source 5 is set to 0 [kV] such that the extraction electrode is at 50 [V], the lens electrode is at 3000 [V] and the anode grounding is at Va of 50 [kV].

Example 8

This example is similar to Example 1 except that tungsten is selected for the shielding member 16, and one of SiC and graphite sheets is selected for the thermally conductive member 17.

Example 9

This example is similar to Example 1 except that an alloy of tungsten and molybdenum (component ratio: tungsten 90%, molybdenum 10%) is selected for the shielding member 16, and an alloy of copper and aluminum (component ratio: copper 90%, aluminum 10%) is selected for the thermally conductive member 17.

Example 10

This example is similar to Example 1 except that tungsten is selected for the shielding member 16 and copper having the fin shape illustrated in FIG. 3 is selected for the thermally conductive member 17.

Any of the examples can satisfactorily serve. Under the described conditions, radiation was emitted, and the dose of occurring radiation was measured. It was confirmed that a stable dose of radiation was acquired. In this case, unnecessary radiation did not leak, and the target was not damaged.

Example 11

Figure 4:
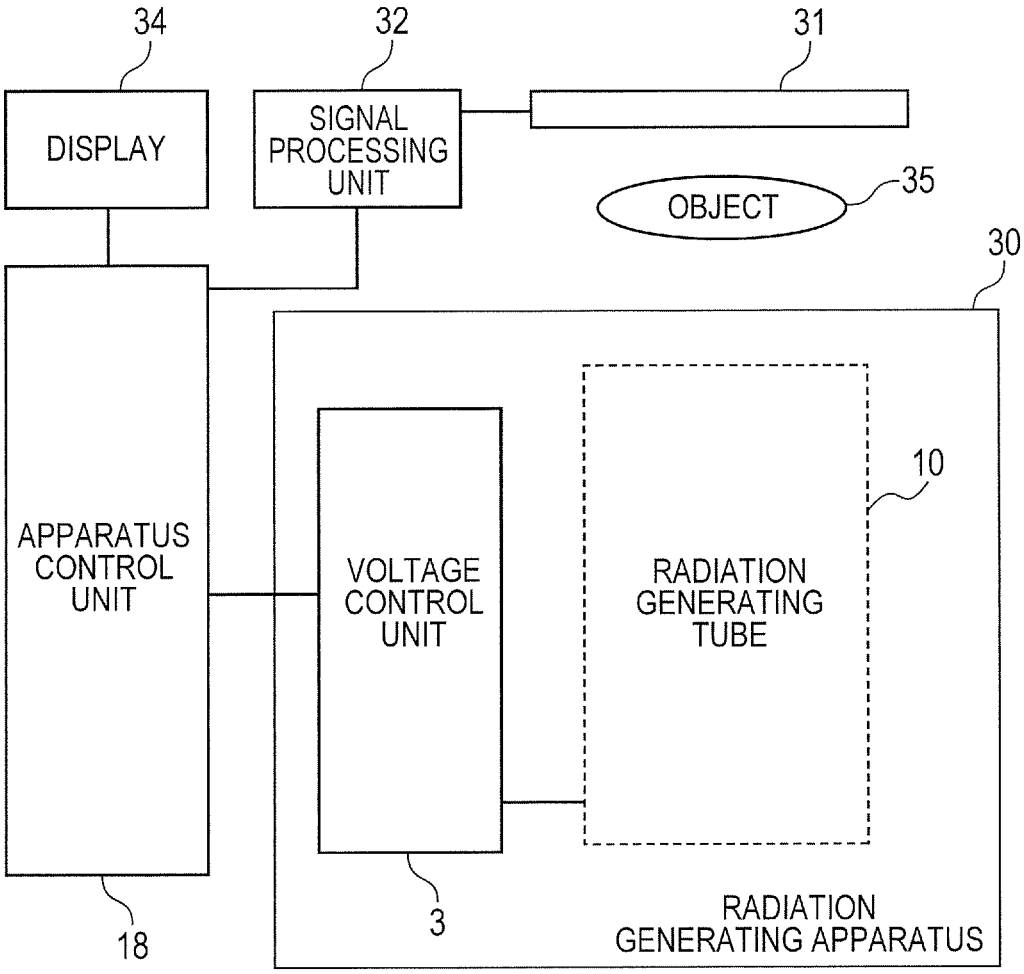
FIG. 4 is a diagram of a configuration of a radiation imaging apparatus using the radiation generating apparatus of the present invention.

Next, referring to FIG. 4, a radiation imaging apparatus using the radiation generating apparatus of the present invention will now be described. The radiation imaging apparatus of this example includes a radiation generating apparatus 30, a radiation detector 31, a signal processing unit 32, an apparatus control unit 33 and a display 34. For instance, any of the radiation generating apparatuses in Example 1 to 10 is suitably adopted as the radiation generating apparatus 30. The radiation detector 31 is connected to the apparatus control unit 33 via the signal processing unit 32. The apparatus control unit 33 is connected to the display 34 and the voltage control unit 3. The process in the radiation generating apparatus 30 is integrally controlled by the apparatus control unit 33. The apparatus control unit 33 controls the radiation generating apparatus 30 and the radiation detector 31 so as to be correlated to each other. Radiation emitted from the radiation generating apparatus 30 passes through an object 35 and is detected by the radiation detector 31. A radiation transmission image of the object 35 is taken. The taken radiation transmission image is displayed on the display 34. The apparatus control unit 33 controls driving of the radiation generating apparatus 30, and controls, via the voltage control unit 3, a voltage signal to be applied to the radiation tube 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-171610, filed Aug. 5, 2011, which is hereby incorporated by reference herein in its entirety.

The invention claimed is:

1. A radiation generating apparatus comprising:

an envelope having a first window through which radiation passes;

a radiation tube being held within the envelope and including a second window through which the radiation passes, wherein the first and second windows are arranged in opposition to each other, a radiation shielding member, with a radiation passing hole in communication with the second window, having a protruding portion protruding from the second window toward a side of the first window, and a thermally conductive member having a higher thermal conductivity higher than that of the radiation shielding member and secured to an outer side of the radiation shielding member; and an insulating fluid filling a space between the envelope and the radiation tube, wherein the thermally conductive member extends along the radiation shielding member and past the radiation shielding member and touches the second window, and the second window is secured to the thermally conductive member.

2. The radiation generating apparatus according to claim 1, wherein the radiation shielding member is arranged at an aperture portion of an evacuated container, which is an outer frame of the radiation tube, and the thermally conductive member is arranged between a wall surface of the aperture portion and the radiation shielding member.

3. The radiation generating apparatus according to claim 1, wherein the radiation shielding member comprises a first radiation shielding portion protruding from the second window toward a side of the first window and a second radiation shielding portion protruding toward a side opposite to the first radiation shielding portion to form an electron beam passing hole in communication with the second window, and the thermally conductive member is arranged at an outer periphery side of the second radiation shielding portion.

4. The radiation generating apparatus according to claim 3, wherein the thermally conductive member is arranged at all of an outer periphery side of the second radiation shielding portion.

5. The radiation generating apparatus according to claim 1, wherein the thermally conductive member has a lower density than that of the radiation shielding member.

6. The radiation generating apparatus according to claim 1, wherein the thermally conductive member and the radiation shielding member are shaped as concentric cylinders, and the thermally conductive member has a larger thickness in a radial direction than that of the radiation shielding member.

7. The radiation generating apparatus according to claim 1, wherein the insulating fluid is an electrically insulating oil.

8. The radiation generating apparatus according to claim 1, wherein the radiation shielding member is connected by a brazing material to the second window.

9. The radiation generating apparatus according to claim 1, wherein the radiation tube has an electron emitting source arranged at an inside of the radiation tube, a target emitting a radiation in response to an irradiation with an electron emitted from the electron source, and a substrate having a surface in opposition to the electron emitting source, wherein the target is formed on the surface, and the second window is formed in the substrate.

10. The radiation generating apparatus according to claim 9, wherein the radiation shielding member is arranged also at a portion including a position in opposition to a position at which the thermally conductive member contacts the target, at an outer periphery of the thermally conductive member.

11. The radiation generating apparatus according to claim 1, wherein the thermally conductive member and the radiation shielding member are formed from metal or alloy materials different from each other.

12. The radiation generating apparatus according to claim 1, wherein the thermally conductive member is a ceramic.

13. The radiation generating apparatus according to claim 1, wherein the thermally conductive member has a fin structure.

14. The radiation generating apparatus according to claim 1, wherein the thermally conductive member is formed from a carbon series material.

15. The radiation generating apparatus according to claim 9, wherein the target and the radiation shielding member are formed from tungsten, and the thermally conductive member is formed from copper.

16. A radiation imaging apparatus comprising:

the radiation generating apparatus according to claim 1;

a radiation detector for detecting a radiation emitted from the radiation generating apparatus and passing through an object; and a controller for controlling the radiation generating apparatus and the radiation detector.

17. The radiation generating apparatus according to claim 8, wherein the brazing material contains silver.

* * * * *